US010214909B1

(12) United States Patent
Bregenzer

(10) Patent No.: US 10,214,909 B1
(45) Date of Patent: Feb. 26, 2019

(54) FLASHING SYSTEM FOR ANCHORING FLEXIBLE ROOFING MEMBRANES AND ITS ASSOCIATED METHOD OF INSTALLATION

(71) Applicant: Michael Bregenzer, Flemington, NJ (US)

(72) Inventor: Michael Bregenzer, Flemington, NJ (US)

( * ) Notice: Subject to any disclaimer, the term of this patent is extended or adjusted under 35 U.S.C. 154(b) by 0 days.

(21) Appl. No.: 15/924,254

(22) Filed: Mar. 18, 2018

(51) Int. Cl.
*E04D 13/14* (2006.01)
*E04D 5/14* (2006.01)

(52) U.S. Cl.
CPC ..... *E04D 13/1415* (2013.01); *E04D 5/146* (2013.01)

(58) Field of Classification Search
CPC .. E04D 5/06; E04D 5/14; E04D 5/142; E04D 5/146; E04D 5/147; E04D 3/38; E04D 3/40; E04D 13/1415
USPC ..... 52/58, 302.6, 302.3, 409
See application file for complete search history.

(56) References Cited

U.S. PATENT DOCUMENTS 720,811 A 2/1903 Ingram
1,452,412 A * 4/1923 Burrows ..... E04D 13/1415 52/59
1,804,315 A * 5/1931 Budd ..... E04D 13/1415 52/60
2,413,588 A * 12/1946 Smith ..... E04D 13/1415 52/58
2,984,049 A * 5/1961 Reddy ..... E04D 13/1415 52/60
3,090,161 A * 5/1963 Edwards ..... E04D 13/1415 52/277
3,237,352 A * 3/1966 Edwards ..... E04D 3/405 52/60
3,277,618 A * 10/1966 Smith ..... E04D 13/1415 52/543
3,405,485 A * 10/1968 Edwards ..... E04D 13/1415 52/300
3,979,860 A * 9/1976 Roth ..... E04D 13/1415 52/61
4,004,381 A * 1/1977 Pichler ..... E04D 13/1415 52/288.1
4,930,275 A * 6/1990 Verby ..... E04D 13/0305 49/DIG. 1
4,932,171 A 6/1990 Beattie
(Continued)

*Primary Examiner* — Brent W Herring
(74) *Attorney, Agent, or Firm* — LaMorte + Associates P.C.

(57) ABSTRACT

A system and method of anchoring a roofing membrane to a vertical wall along the periphery of a flat roof. The roof membrane is partially extended up any peripheral wall that abuts the flat roof. A mounting plate is affixed to the peripheral wall with mechanical fasteners. A portion of the roofing membrane becomes locked between the mounting plate and the peripheral wall. A tubular structure is provided on the mounting plate that faces away from the roofing membrane. A cover plate is provided. The cover plate is mounted to the tubular structure on the mounting plate. The cover plate covers and protects the mounting plate and the edge of the roofing membrane under the mounting plate. The cover plate is attached with mechanical fasteners. The tubular structure provides room for the mechanical fasteners to terminate without compromising the mounting plate that is pressed against the roofing membrane.

13 Claims, 5 Drawing Sheets

(56) References Cited

U.S. PATENT DOCUMENTS

| | | | | | |
|---|---|---|---|---|---|
| 4,996,801 | A * | 3/1991 | Ristow | E04D 5/142 | 52/273 |
| 5,263,287 | A | 11/1993 | Lyons, Jr. | | |
| 5,309,685 | A | 5/1994 | Rathgeber et al. | | |
| 5,469,671 | A | 11/1995 | Rathgeber et al. | | |
| 5,711,116 | A | 1/1998 | Hasan | | |
| 5,937,603 | A * | 8/1999 | Zeidler | A62C 3/02 | 52/408 |
| 6,108,981 | A * | 8/2000 | Sama | E04D 13/1415 | 52/58 |
| 6,167,660 | B1 * | 1/2001 | Sama | E04D 13/1415 | 52/58 |
| 7,594,369 | B2 | 9/2009 | Kelly | | |
| 8,061,098 | B2 | 11/2011 | Whelan et al. | | |
| 8,407,945 | B2 * | 4/2013 | Kelly | E04D 13/155 | 52/300 |
| 8,959,853 | B2 * | 2/2015 | Bortell | E04D 13/0459 | 52/219 |
| 2002/0178671 | A1 * | 12/2002 | Gembala | E04D 3/405 | 52/302.6 |
| 2009/0056262 | A1 * | 3/2009 | Kelly | E04D 3/405 | 52/408 |

* cited by examiner

FLASHING SYSTEM FOR ANCHORING FLEXIBLE ROOFING MEMBRANES AND ITS ASSOCIATED METHOD OF INSTALLATION

BACKGROUND OF THE INVENTION

1. Field of the Invention

In general, the present invention relates to flashing systems that are used to terminate the edges of flexible roofing membranes. More particularly, the present invention relates to flashing systems that are used to terminate and anchor a flexible roofing membrane that is applied to a roof surrounded by a peripheral wall.

2. Prior Art Description

Many large buildings have flat roofs. To make the roofs waterproof, the roofs are covered in waterproof material. Often, the waterproof material used to cover the roof is a flexible roofing membrane. The roofing membrane is a large engineered sheet of water impervious material. The roofing membrane covers the surface of the roof and prevents rain and melting snow from seeping through the roof.

On many buildings with flat roofs, the area of the flat roof is outlined by a parapet or other peripheral wall. This is especially true of buildings made of stone or brick. Peripheral walls serve two primary purposes. First, the peripheral walls prevent objects, such as HVAC equipment, ventilation ducts, skylights, and the like from being visible from the ground. This keeps the aesthetics of the building clean. Second, the peripheral walls prevent any people and objects that may be present on the flat roof from accidentally falling off the roof.

Depending upon the season and weather conditions, it is not unusual for small amounts of water to accumulate on a flat roof within the confines of the peripheral walls. For example, the presence of snow and ice on a flat roof can obstruct the rooftop drainage system. This causes small pools of melt water to collect on the roof. These pools of water may contact one or more of the peripheral walls. It is for this reason that when a waterproof membrane is applied to a flat roof, it is also applied a short distance up each of the peripheral walls that outline the flat roof. This creates a bathtub structure that provides waterproof protection to the roof as well as to the lower sections of the peripheral walls. In this manner, the edges of the waterproof membrane remain elevated above the level of any pooling water and the chances of water seeping past the edge of the membrane are greatly decreased.

Often, peripheral walls that surround a flat roof have a flashing detail that is built into the wall when the wall is constructed. The flashing detail is typically a thin plate of a stable metal, such as copper, that is set between bricks or stones. As such, the flashing detail extends into the peripheral wall. The flashing detail prevents rain water from traveling down the vertical face of the peripheral walls and reaching any seam that may be present between the vertical peripheral walls and the flat horizontal roof.

When a waterproof roofing membrane is installed onto a flat roof, the edges of the membrane are typically positioned just under the flashing detail that extends from the peripheral walls. Traditionally, this installation is achieved by applying roofing tar to the peripheral walls under the flashing element and pressing the roofing membrane against the tar. In this manner, the goal is that the flashing detail will protect the edge of the waterproof membrane and prevent water from seeping passed the tar between the peripheral wall and the membrane. In practice, such attachment methods are unreliable. During installation, folds inevitably occur in the roofing membrane that prevent a flush seal against the peripheral wall. Furthermore, forces caused by thermal expansion and contraction cause the roofing membrane to pull away from the parapet wall over time. This slowly opens gaps between the roofing membrane and the peripheral walls into which rain water can leak.

In an attempt to make the anchoring and sealing of roofing membranes more reliable, flashing systems have been developed that are used to secure the roofing membrane to the peripheral walls in a more secure fashion. The flashing systems use various metal flashings that are bolted to the peripheral wall and clamp the roof membrane against the peripheral wall. Such prior art flashing systems are exemplified by U.S. Pat. No. 7,594,369 to Kelly. Although such prior art flashing systems work better than roofing tar alone, such prior art systems have drawbacks. Often, such prior art systems are expensive to manufacture and difficult to install. The increased time and labor required for installation add significantly to the overall costs of the roofing project.

A need therefore exists for an improved flashing system that can be used to secure a roofing membrane to a peripheral wall, wherein the flashing system is inexpensive to produce and easy to install. This need is met by the present invention as described and claimed below.

SUMMARY OF THE INVENTION

The present invention is a system and method of anchoring a roofing membrane to a vertical wall along the periphery of a flat roof. The roofing membrane is applied to the roof in a traditional manner. The roof membrane is partially extended up any peripheral wall that abuts the flat roof. The membrane is cut so that it terminates at the same elevation along the length of the peripheral wall.

A mounting plate is provided. The mounting plate mounts to the peripheral wall with mechanical fasteners. A portion of the roofing membrane near its cut edge becomes locked between the mounting plate and the peripheral wall. As such, the mounting plate anchors the cut edges of the roofing membrane. The mounting plate has a flat surface that is pressed against the roofing membrane. A tubular structure is provided on the mounting plate that faces away from the roofing membrane and the peripheral wall.

A cover plate is provided. The cover plate is mounted to the tubular structure on the mounting plate. The cover plate covers and protects the mounting plate and the edge of the roofing membrane under the mounting plate. The cover plate is attached with mechanical fasteners. The tubular structure provides room for the mechanical fasteners to terminate without compromising the flat surface of the mounting plate that is pressed against the roofing membrane.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention flashing system 10 can be adapted for use with many types of roofs and with many types of roofing membranes, only one exemplary embodiment is illustrated and described. The exemplary embodiment shows the flashing system 10 being applied to a short peripheral wall that abuts a flat roof. The embodiment is selected in order to set forth one of the best modes contemplated for the invention. The illustrated embodiment, however, is merely exemplary and should not be considered a limitation when interpreting the scope of the appended claims.

Figure 1:
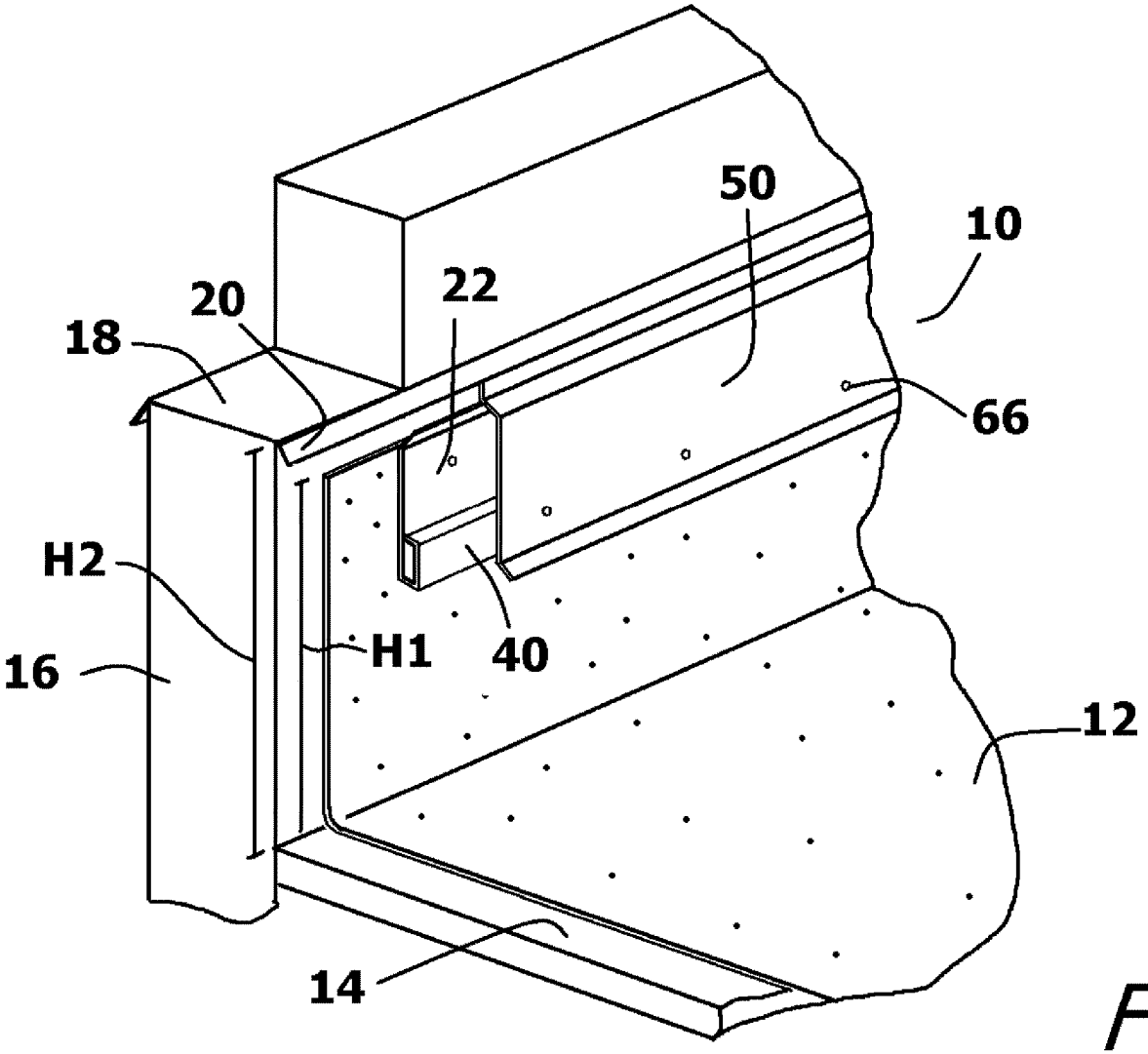
FIG. 1 is a fragmented perspective view of an exemplary embodiment of a flashing system affixed to a flat roof with a peripheral wall.
Figure 2:
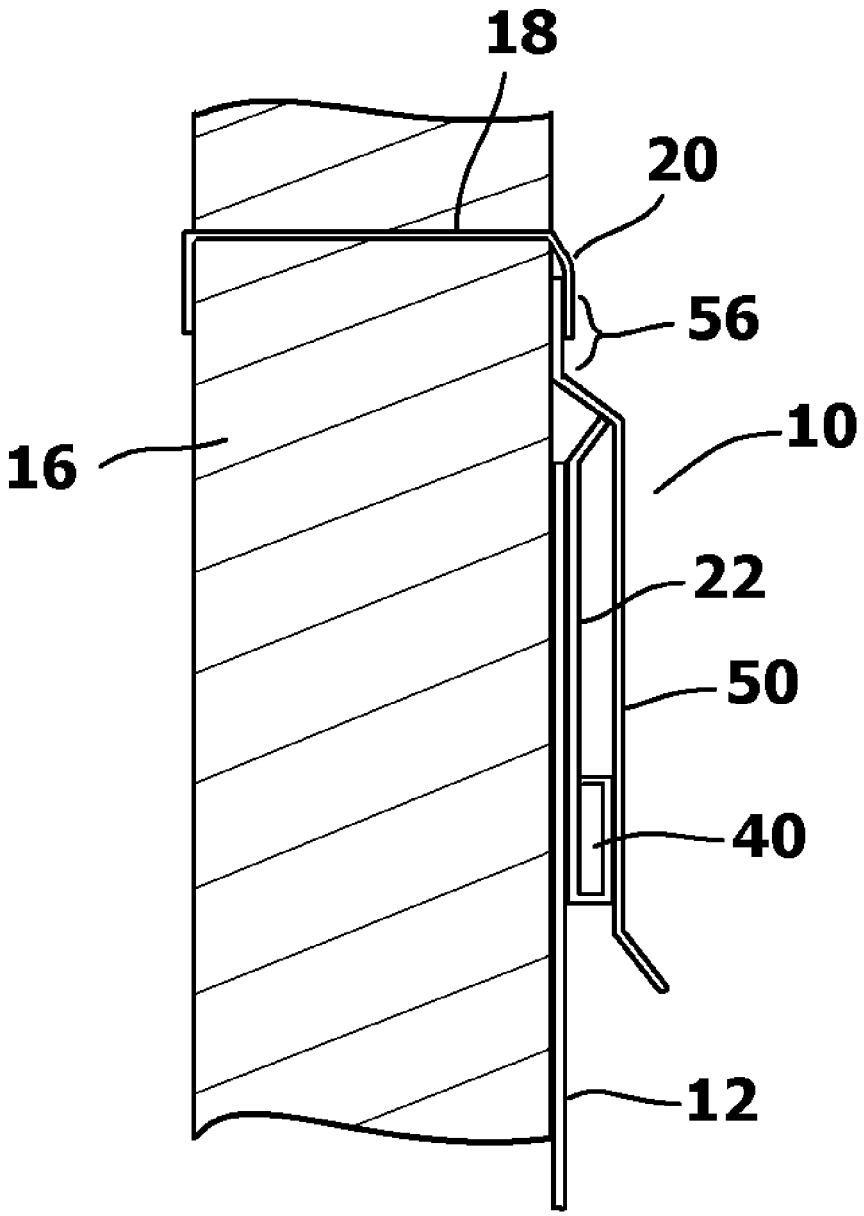
FIG. 2 is a cross-sectional view of the exemplary embodiment of FIG. 1.

Referring to FIG. 1 in conjunction with FIG. 2, a flashing system 10 is shown that is used to anchor a roofing membrane 12 to a flat roof 14. The flashing system 10 anchors the roofing membrane 12 to a peripheral wall 16 that abuts the flat roof 14. The peripheral wall 16 typically has a flashing detail 18 that is built into the peripheral wall 16. The flashing detail 18 creates an angled lip 20 that extends from the peripheral wall 16 toward the area of the flat roof 14. The flashing detail 18 is elevated above the flat roof 14 by a height H1, wherein the height H1 is typically between eight inches and twenty four inches. The angled lip 20 of the flashing detail 18 that extends from the peripheral wall 16 has a typical length of between 0.5 inches and 2.0 inches and is intended to prevent rain water from running down the vertical surfaces of the peripheral wall 16.

Figure 3:
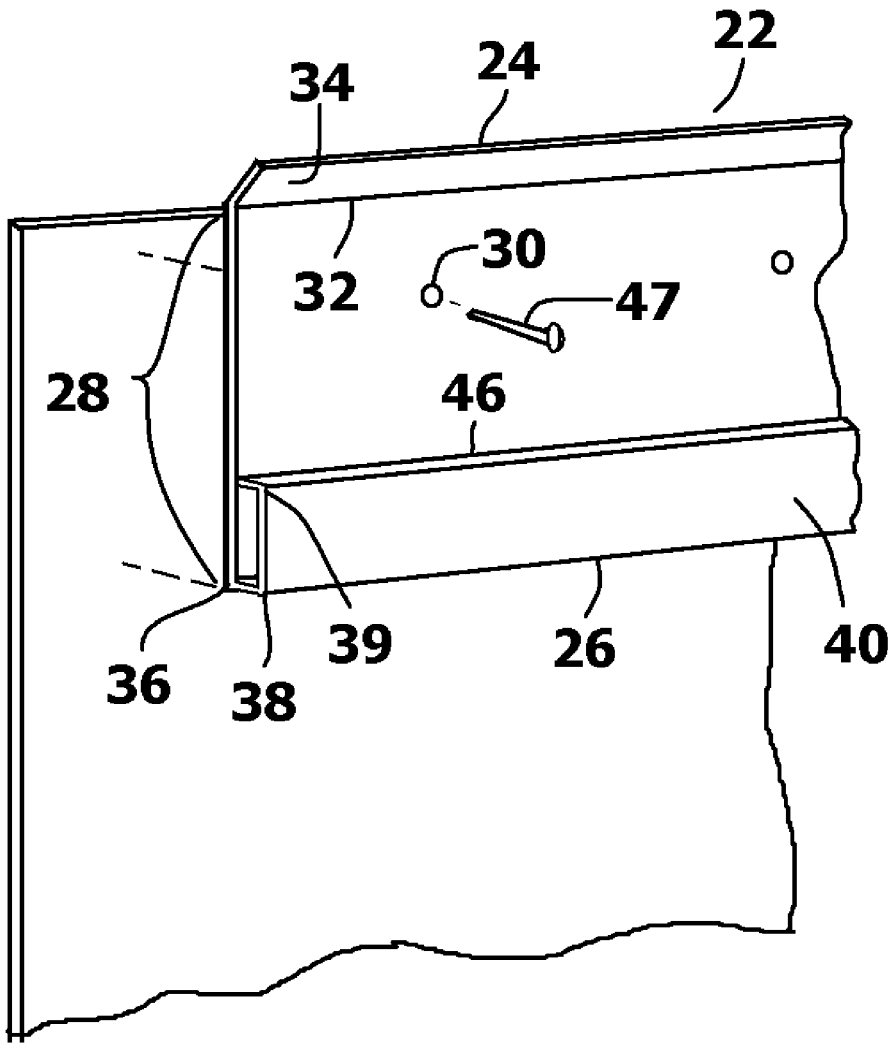
FIG. 3 shows an enlarged, isolated perspective view of the mounting plate component of the exemplary embodiment shown in conjunction with a segment of roofing membrane.
Figure 4:
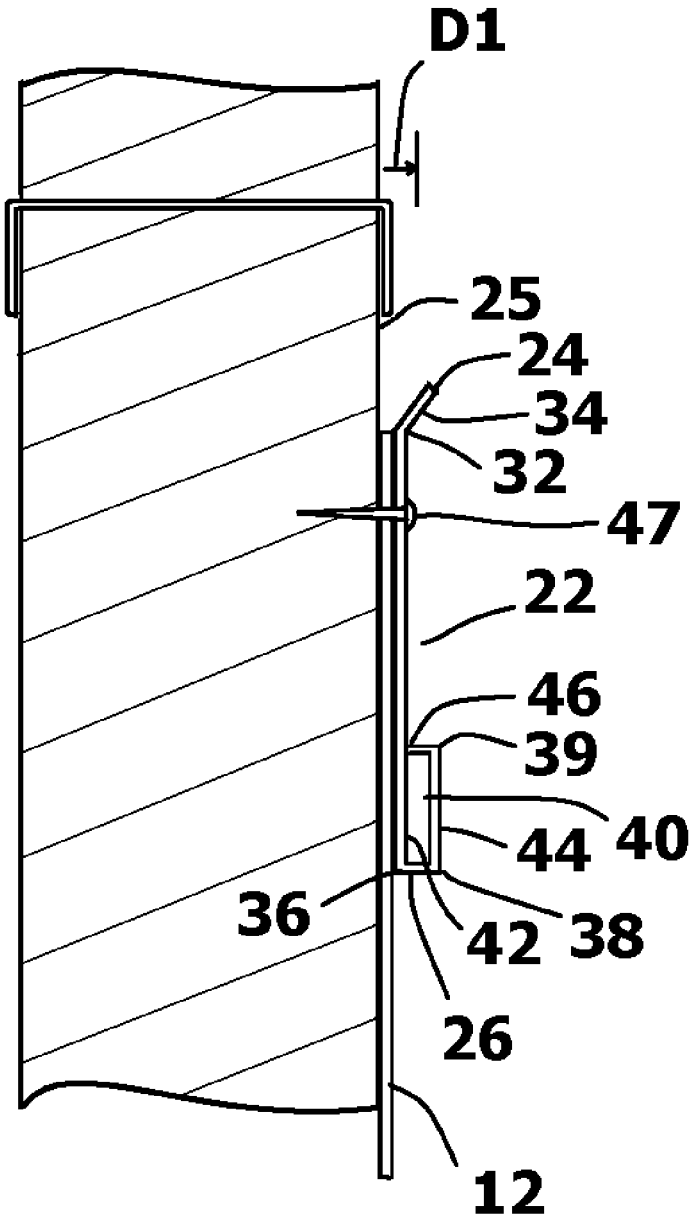
FIG. 4 is a cross-sectional view of the embodiment of FIG. 3.

The purpose of the flashing system 10 is to anchor the roofing membrane 12 to the peripheral wall 16 in such a way that water is incapable of seeping between the peripheral wall 16 and the roofing membrane 12. Referring to FIG. 3 and FIG. 4 in conjunction with FIG. 1 and FIG. 2, it can be seen that in a first step, a roofing membrane 12 is applied to a flat roof 14 in a traditional manner, using traditional adhesives. The roofing membrane 12 is extended up the peripheral wall 16 to a height H2, which is approximately three inches to five inches below the height H1 of the flashing detail 18 built into the peripheral wall 16. This leaves an open area 25 between the roofing membrane 12 and the flashing detail 18.

A mounting plate 22 is provided. The mounting plate 22 has a length that runs the length of the peripheral wall 16. Depending upon the length of the peripheral wall 16, the mounting plate 22 can be made to be continuous or can be segmented with adjacent parts in abutment to create a longer length. If two mounting plates 22 are used in abutment, the seam at the point of abutment is coated with a sealant to ensure that no water can run through the seam.

The mounting plate 22 has a top edge 24 and a parallel bottom edge 26. When mounted to the peripheral wall 16, the top edge 24 and the bottom edge 26 of the mounting plate 22 are horizontal and parallel to the plane of the flat roof 14. The mounting plate 22 has a preferred width of three inches to six inches, between the top edge 24 and the bottom edge 26. Within that width is a flat contact section 28. The flat contact section 28 occupies at least 75% of the overall width. Mounting holes 30 are formed through the flat contact section 28. The mounting holes 30 are preferably evenly spaced and linearly aligned a short distance below the top edge 24 of the mounting plate 22.

A bend line 32 is disposed at the end of the flat contact section 28 proximate the top edge 24. The bend line 32 is parallel to the top edge 24. At the bend line 32, the mounting plate 22 is bent at an acute bend angle of between thirty degrees and sixty degrees. This produces a flare 34 that extends from the flat contact section 28 to the top edge 24. The flare 34 extends away from the plane of the flat contact section 28 by a distance D1.

A second bend line 36 is created at the bottom edge 26 of the flat contact section 28. The second bend line 36 leads to a third bend line 38 and a fourth bend line 39. The various parallel bend lines 36, 38, 39 create a tubular structure 40 proximate the bottom edge 26. The tubular structure 40 has a flat back surface 42 that is part of the flat contact section 28. The tubular structure 40 also has a flat front surface 44 that extends between the second bend line 36 and the third bend line 38. The tubular structure 40 is hollow, wherein a distance D2 between the flat back surface 42 and the flat front surface 44 of the tubular structure 40 is generally equal to the projection distance D1 of the top flare 34. That is, the flat front surface 44 of the tubular structure 40 and the top flare 34 terminate in or near the same vertical plane.

The mounting plate 22 can be made from bending a single sheet of metal, such as copper. If that is the case, the material of the mounting plate 22 would end at the seam 46 after the third bend line 38 where the tubular structure 40 curves back into contact with the flat back surface 42. The seam 46 is brazed, welded or otherwise sealed to ensure that the seam 46 is watertight.

It should be understood that the mounting plate 22 need not be bent from a flat piece of metal. Rather, the mounting plate 22 can be extruded from either metal or plastic. If extruded, it will be understood that each "bend" as previously described, merely refers to points where the progression of the material changes direction.

The mounting plate 22 is placed over the roofing membrane 12 on the peripheral wall 16 so that the roofing membrane 12 is interposed between the peripheral wall 16 and the mounting plate 22. The open area 25 below the flashing detail 18 remains uncovered. The mounting plate 22 is anchored in place by advancing mechanical fasteners 47 through the mounting holes 30 in the mounting plate 22. The type of mechanical fasteners 47 depends upon the composition of the peripheral walls 16. The mechanical fasteners 47 can be wood screws if the peripheral wall 16 is made of wood or has wood sheathing. If the peripheral wall 16 is brick or stone, the mechanical fasteners 47 can be masonry screws, masonry anchors, or the like.

Figure 5:
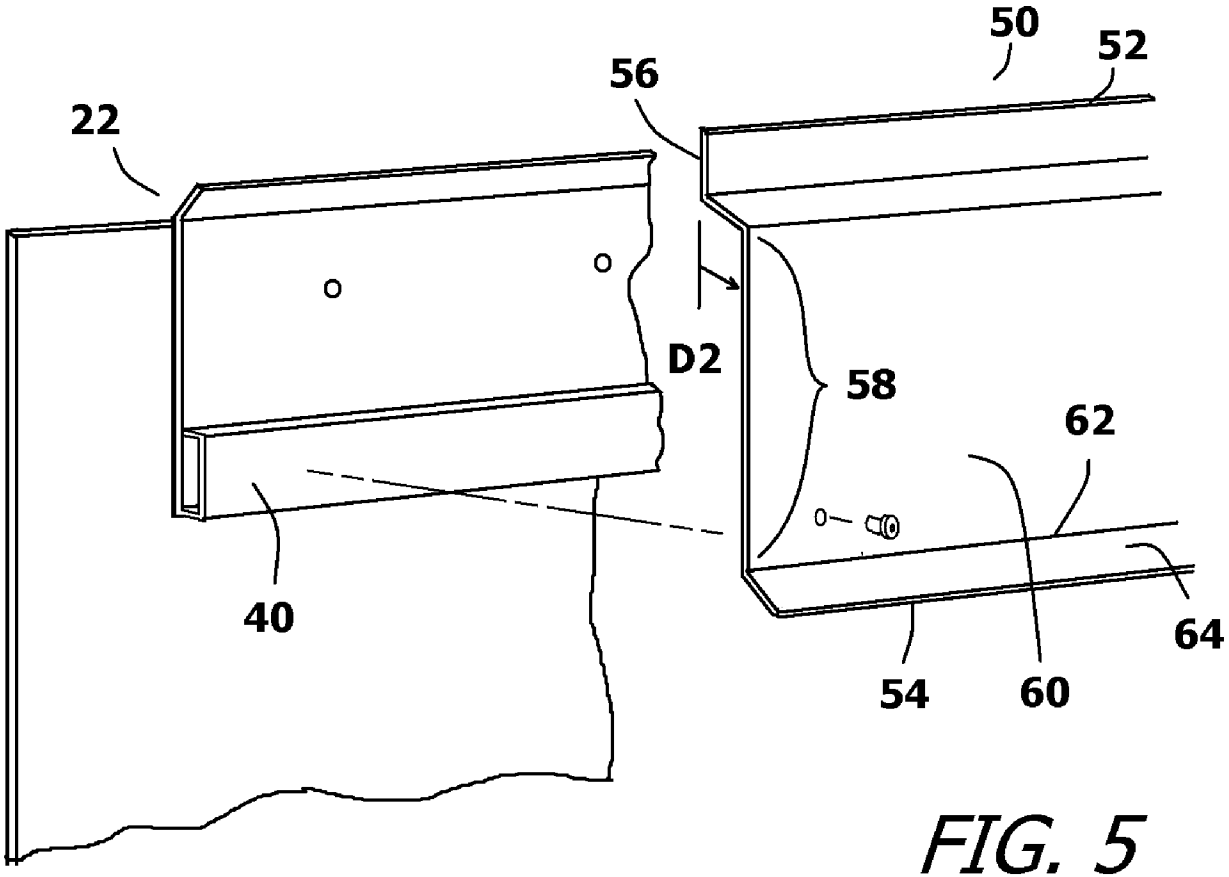
FIG. 5 shows an enlarged, perspective view of the cover plate component of the exemplary embodiment shown in conjunction with a segment of the mounting plate and roofing membrane.

Referring to FIG. 5 in conjunction with FIG. 2, it can be seen that a cover plate 50 is provided. The cover plate 50 has a first edge 52 and a parallel second edge 54. A first flat section 56 extends from the first edge 52 in the same plane as the first edge 52. The first flat section 56 extends between one and three inches from the first edge 52. At the end of the first flat section 56, opposite the first edge 52, the cover plate 50 transitions to a plateau section 58. The plateau section 58 has a second flat section 60 that is parallel to the first flat section 56. However, the plane of the second flat section 60 is offset from the plane of the first flat section 56 by a distance D2. The distance D2 is generally equal to the depth D1 of the tubular structure 40 on the mounting plate 22.

The plateau section 58 has a bend line 62 that runs the length of the cover plate 50 proximate the second edge 54.

The cover plate 50 is bent at an acute angle along the bend line 62, therein forming a bottom flare 64. The bottom flare 64 leads from the bend line 62 to the second edge 54.

The cover plate 50 is preferably made of the same material as the mounting plate 22 so as to have the same thermal expansion profile. Accordingly, the cover plate 50 can be bent from a piece of metal or extruded.

With reference to FIG. 5 in conjunction with FIG. 1 and FIG. 2, it will be understood that the cover plate 50 is installed over the mounting plate 22. The mounting plate 22 has been previously mounted to the peripheral wall 16 over the roofing membrane 12. This anchors the roofing membrane 12 in place. The cover plate 50 covers the open area 25 under the flashing detail 18 and protects the mounting plate 22 and the seal made between the mounting plate 22 and the peripheral wall 16. The first edge 52 and a portion of the flat section 56 of the cover plate 50 are positioned in the open area 25 under the angled lip 20 of the flashing detail 18 on the peripheral wall 16. The flat section 56 lays flush against the peripheral wall 16. The presence of the flashing detail 18 immediately above the top edge, prevents any water from running down the peripheral wall 16 and flowing against the first edge 52. Accordingly, water cannot seep past the first edge 52 of the cover plate 50.

The plateau section 58 of the cover plate 50 passes over the tubular structure 40 of the mounting plate 22. The plateau section 58 lays flush against the tubular structure 40 of the mounting plate 22 as the first flat section 56 of the cover plate 50 lays flush against the peripheral wall 16. A second set of mechanical fasteners 66 are used to mechanically interconnect the plateau section 58 of the cover plate 50 to the tubular structure 40 of the mounting plate 22. The preferred mechanical fastener 66 is a pop rivet. However, sheet metal screws can also be used. The mechanical fasteners 66 pass through the material of the cover plate 50 and through the flat front surface 44 of the tubular structure 40. The hollow within the tubular structure 40 provides space for the mechanical fasteners 66 to terminate without compromising the seal made between the mounting plate 22 and the peripheral wall 16. If the mechanical fasteners 66 are pop-rivets, the hollow is preferably at least ¼ inch deep to accommodate the head of the pop-rivet.

Once the second set of mechanical fasteners 66 are installed, the cover plate 50 is affixed to the mounting plate 22. Any water that runs down the peripheral wall 16 will be deflected away from the peripheral wall 16 by the flashing detail 18 built into the peripheral wall 16. The deflected water will flow onto the outside of the cover plate 50. The water will run down the exterior of the cover plate 50 until it reaches the bottom flare 64 near the second edge 54. The bottom flare 64 deflects the water away from the peripheral wall 16 as it falls from the cover plate 50. The result is that the segment of the roofing membrane 12 that is interposed between the mounting plate 22 and the peripheral wall 16 is kept dry and shielded from the elements. Accordingly, no water can flow between the roofing membrane 12 and the peripheral wall 16.

It will be understood that the embodiment of the present invention that is illustrated and described is merely exemplary and that a person skilled in the art can make many variations to that embodiment. All such embodiments are intended to be included within the scope of the present invention as defined by the claims.

What is claimed is:

1. In a rooftop application where a roofing membrane is applied to a roof that abuts a vertical wall, a method of anchoring said roofing membrane to said vertical wall, said method comprising the steps of:

providing a mounting plate having a top edge, a bottom edge, and a tubular structure that runs along said mounting plate parallel to both said top edge and said bottom edge;

mounting said mounting plate to said vertical wall, wherein a portion of said roofing membrane is interposed between said mounting plate and said vertical wall, therein locking said portion of said roofing membrane in place against said vertical wall;

providing a cover plate;

providing mechanical fasteners;

mounting said cover plate to said tubular structure of said mounting plate by advancing at least some of said mechanical fasteners through said cover plate and into said tubular structure, wherein said cover plate covers and protects said mounting plate.

2. The method according to claim 1, wherein mounting said mounting plate to said vertical wall includes extending at least some of said mechanical fasteners through said mounting plate into said vertical wall.

3. The method according to claim 2, wherein providing a mounting plate includes providing a mounting plate with periodic mounting holes formed therethrough, wherein at least some of said mechanical fasteners extend through said mounting holes.

4. The method according to claim 1, wherein said vertical wall runs a first length and said mounting plate has a second length that matches said first length.

5. The method according to claim 1, wherein providing a mounting plate includes forming said mounting plate from a sheet of metal and forming said tubular structure by forming bends in said sheet of metal.

6. The method according to claim 1, wherein said vertical wall has a flashing detail extending therefrom.

7. The method according to claim 6, wherein providing a cover plate includes providing a cover plate that extends from a first edge to a second edge, wherein said first edge passes under said flashing detail on said vertical wall.

8. In a rooftop application where a roofing membrane is applied to a roof that abuts a vertical wall with an extending flashing detail, a method of anchoring said roofing membrane to said vertical wall, said method comprising the steps of:

providing a mounting plate having a top edge, a bottom edge, and a tubular structure that runs along said mounting plate parallel to both said top edge and said bottom edge;

mounting said mounting plate to said vertical wall a first distance below said flashing detail, therein leaving a segment of said vertical wall exposed between said flashing detail and said mounting plate, wherein a portion of said roofing membrane becomes locked between said mounting plate and said vertical wall;

providing a cover plate;

providing mechanical fasteners;

mounting said cover plate to said tubular structure of said mounting plate by advancing at least some of said mechanical fasteners through said cover plate and into said tubular structure, wherein said cover plate covers said mounting plate and said portion of said vertical wall between said flashing detail and said mounting plate.

9. The method according to claim 8, wherein mounting said mounting plate to said vertical wall includes extending at least some of said mechanical fasteners through said mounting plate and into said vertical wall.

10. The method according to claim 9, wherein providing a mounting plate includes providing a mounting plate with periodic mounting holes formed therethrough, wherein at least some of said mechanical fasteners extend through said mounting holes.

11. The method according to claim 8, wherein said vertical wall extends a first length and said mounting plate has a second length that matches said first length.

12. The method according to claim 8, wherein providing a mounting plate includes forming said mounting plate from a sheet of metal and forming said tubular structure by forming bends in said sheet of metal.

13. The method according to claim 8, wherein providing a cover plate includes providing a cover plate that extends from a first edge to a second edge, wherein said first edge extends under said flashing detail on said vertical wall when said cover plate is mounted to said mounting plate.

* * * * *